United States Patent [19]

Morgan

[11] 3,941,511

[45] Mar. 2, 1976

[54] ARTIFICIAL LIFT FOR OIL WELLS

[76] Inventor: Thomas H. Morgan, 800 NW. Loop 410, San Antonio, Tex. 78216

[22] Filed: Jan. 31, 1975

[21] Appl. No.: 545,779

Related U.S. Application Data

[62] Division of Ser. No. 476,212, June 4, 1974, Pat. No. 3,894,814.

[52] U.S. Cl. ..... 417/57; 417/58; 417/86; 417/392

[51] Int. Cl.[2] F04B 47/12; F04B 23/14; F04B 35/00

[58] Field of Search ..... 417/86, 56, 57, 58, 59, 417/392

[56] References Cited

UNITED STATES PATENTS

| | | | |
|---|---|---|---|
| 3,020,848 | 2/1962 | Green | 417/392 X |
| 3,090,316 | 5/1963 | Montgomery | 417/58 X |
| 3,106,170 | 10/1963 | Gray | 417/138 |
| 3,797,968 | 3/1974 | Elferr | 417/145 X |

*Primary Examiner*—Carlton R. Croyle
*Assistant Examiner*—Richard E. Gluck
*Attorney, Agent, or Firm*—Cox, Smith, Smith, Hale & Guenther Incorporated

[57] ABSTRACT

An apparatus for retrieving oil from a producing zone after the bottom hole pressure has decreased to such an extent that artificial lift is required for production. An accumulator is positioned in the area of the casing where oil accumulates with the uppermost portion being vented to atmosphere to allow oil flow therein. A floating piston-type device may be located immediately above the accumulator with a bypass from the accumulator to the top of the floating piston. Pressure is subsequently applied through the vent line to the accumulator to force oil from the accumulator through a stinger tube above the floating piston and subsequently raise the oil and floating piston to the surface. Without the piston, a stinger tube and standing valve may be used to accumulate oil in the production tubing.

10 Claims, 3 Drawing Figures

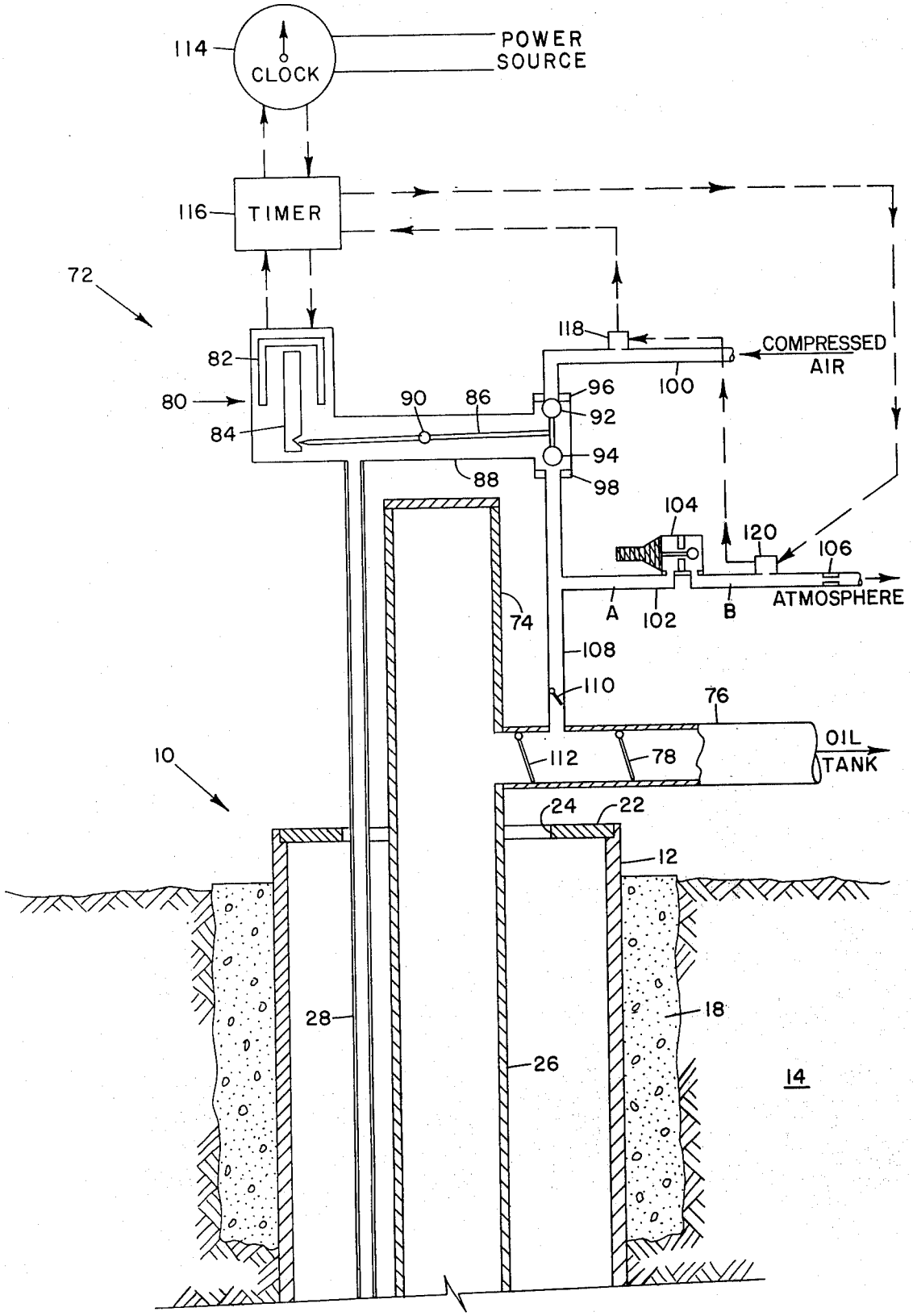
FIG. 1-a

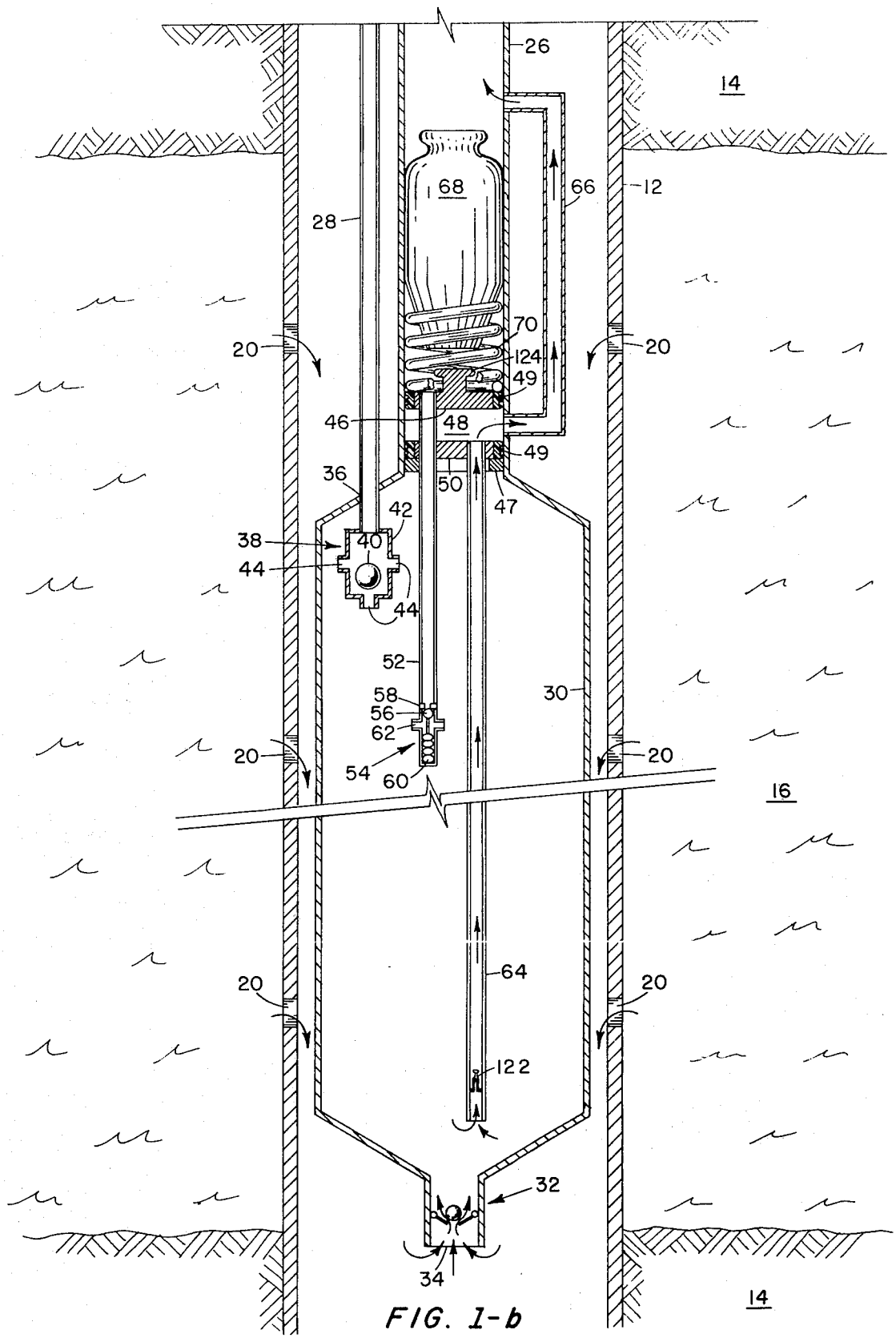
FIG. 1-b

ARTIFICIAL LIFT FOR OIL WELLS

This is a division of application Ser. No. 476,212, filed June 4, 1974.

BACKGROUND OF THE INVENTION

This invention relates to oil recovery devices and, more specifically, to an artificial lift for recovering oil from wells that do not have sufficient bottom hole pressure to raise the oil to the surface. The apparatus includes an accumulator to receive the oil in the casing and a vent line to the surface which may subsequently be pressurized to raise the oil contained in the accumulator into the production tubing and subsequently the well head.

DESCRIPTION OF THE PRIOR ART

There are several stages in the productive life of an oil well that should be reviewed before going tinto the details of the present invention. When a hydrocarbon producing well (oil well) is drilled, the initial stage of production normally does not require any type of lift mechanism to raise the oil from the producing formation to the well head. The pressure on the oil itself is sufficient to raise the petroleum (gas and oil) to the well head. As oil is produced from the oil reservoir, the bottom hole pressure will continue to drop until it reaches a point where the bottom hole pressure is no longer sufficient to raise the column of oil to the well head.

Once the bottom hole pressure has reduced to such an extent that it will no longer raise the column of oil to the well head, steps can be taken to reduce the weight of the column. A column of fluid from the oil reservoir to the well head that does not contain gas weighs more than a column that does contain gas. Therefore, a system called gas lift and commonly used by the petroleum industry is to bubble gas up through the column of oil thereby reducing the weight of the column and to cause the oil from the well to continue to flow. Now the bottom hole pressure is sufficient to raise the lightened column to the well head for a normal production flow. This continues until the bottom hole pressure is again reduced to a greater degree so that it is no longer sufficient to raise the lightened column to the surface of the well.

The next stage in the productive life of an oil well under present day operating conditions would be to allow the oil to accumulate in the tubing and then to pressurize the casing. By having a gas lift valve below the oil accumulated in the tubing, a blob of oil could be raised to the surface. Thereafter, the pressure on the casing would be relieved and oil would be allowed to accumulate again in the tubing. This process is repeated again and again by allowing oil to accumulate in the tubing, pressurizing the casing and raising the blob of oil to the well head and relieving the pressure to allow oil accumulated again in the tubing. This process has been aided somewhat by the use of swabs or subsurface plungers (commonly called free floating pistons) with the swabs or plungers allowing the oil to accumulate above their location in the production tubing. Thereafter, further pressure increases in the casing would raise both the oil and the swab or plunger to the surface. Subsequently, the swab or plunger would be allowed to fall back to its original position in the tubing and the cycle repeated.

Because the casing, which is alternately pressurized and depressurized, can only stand a certain amount of pressure, even the type of gas lift just described has limited application. At this stage of the productive life of the well, some type of subsurface pump is needed to raise oil to the surface of the well. Bottom hole pumps are very expensive, wear out and must be replaced periodically. It becomes a matter of economics as to when the bottom hole pressure is no longer sufficient to discharge enough oil from the well to justify the cost of maintaining the costly well equipment. At this point in time, the well is usually abandoned unless other drastic steps such as flooding the production zone are used. At this particular point the bottom hole pressure has dropped to substantially zero.

Some production has occurred in old petroleum fields by drilling holes well below the productive zone. Actions such as latent water drives, formation compression, gravity and many other contributing factors may cause oil to gradually fill the holes drilled below the productive zone. However, to remove the oil that has accumulated in the hole drilled below the productive zone (commonly called sump bores) is very costly, again requiring some type of subsurface pump to raise the oil to the surface of the well. Such production is normally economically unfeasible.

It should be noted in the previously described gas lift systems that a gas source may be necessary; however, most of the gas used in lifting can be recovered through a tank separator. Air could not be used because of the mixing of the air and oil to cause an emulsion.

SUMMARY OF THE INVENTION

The present invention is directed towards an economical means and apparatus for continuing production of an oil well after it becomes economically unfeasible using normal production techniques. An accumulator is positioned in the oil that naturally drains into the oil well. A vent line allows the accumulator to be at the same pressure as atmosphere so that the oil will fill the accumulator. Thereafter, the accumulator is pressurized through the vent line, forcing the oil through a standing valve and stringer tube into the production tubing. In the embodiment using a floating piston or swab, a bypass line moves the oil above the free floating piston or swab. As the pressure further increases in the accumulator, a gas lift valve below the free floating piston or swab will open, thereby causing the piston and oil accumulated avove the piston to rise to the surface of the well. Once the piston has reached the top of the well, pressure in the accumulator is vented through the oil line to further kick the oil into the oil tank and, simultaneously, the piston is allowed to fall back into its position immediately above the accumulator. As oil again collects in the accumulator the previously mentioned cycle is repeated. A ball float valve in the air line tells an electronic control circuit and an associated pressure switch when the accumulator has been filled; therefore, it is time to pressurize the accumulator and raise the oil to the surface. An appropriate clock mechanism is used to time the cycle to control the compressed air in and out of the accumulator.

In another embodiment, the stinger tube simply feeds through a seal area above the accumulator into the production tubing. Upon pressurizing the accumulator, oil moves through the standing valve and stinger tube into the production tubing. Pressure is then relieved and oil again collects in the accumulator with the standing valve preventing the previous collected oil from feeding back from the production tubing into the accumulator. By alternately venting and pressurizing the accumulator, the oil is moved up the production tubing to the well head. Once the oil has been collected in the accumulator, it is never lost, and once the oil enters the production tubing, it never reenters the accumulator.

Therefore, it is an object of the present invention to provide an apparatus for gathering oil from a well once the well has stopped flowing due to a decrease in pressure of the reservoir.

It is a further object of the present invention to provide artificial lift for an oil well that utilizes the minimum of equipment so that it is economically feasible to continue production from an oil well in ranges of approximately 1 barrel per day.

It is still another object of the present invention to position an accumulator in oil that would naturally accumulate in the bottom of the well, vent the top of the accumulator to the atmosphere to allow oil to flow through a check valve into the accumulator, subsequently pressurizing the accumulator, thereby forcing oil up through a stringer tube and bypass tube to a position above a free floating piston or swab, and by continued pressurization operating a gas lift valve to lift the free floating piston or swab with the oil contained thereabove to the well head.

It is yet another object of the present invention to use a ball float valve in the vent line in combination with a pressure switch and choke located at the surface to give a signal indication when the accumulator is full of oil. The signal is then used to trigger control circuitry that would be used to pressurize the accumulator.

It is still another object of the present invention to use a gas lift valve underneath the free floating piston or swab so that pressure in the accumulator must exceed a certain point before the free floating piston or swab will begin to rise to the surface. The gas lift valve should be set for a sufficiently high pressure so that almost all of the oil in the accumulator is raised above the free floating piston or swab before the gas lift valve opens.

It is yet another object of the present invention to provide a retrievable apparatus immediately above the accumulator to allow direct access to the accumulator and to the bottom of the well.

It is yet another object of the present invention to provide a system that can be used in the producing of an oil field wherein each of the wells in the oil field have a low volume output and require some type of artificial lift.

Yet another object of the present invention is to provide an accumulator located in the oil that collects in the casing, the accumulator being alternately vented to the atmosphere to collect oil and pressurized to force the oil through a standing valve in a stinger tube into the production tubing, the oil column in the production tubing continually increasing until it reaches the well head and flows with each cycle.

BRIEF DESCRIPTION OF THE DRAWINGS

FIG. 1 is an elevated sectional view of the artificial lift apparatus of the present invention and the associated controls.

DESCRIPTION OF THE PREFERRED EMBODIMENT

Figure 2:
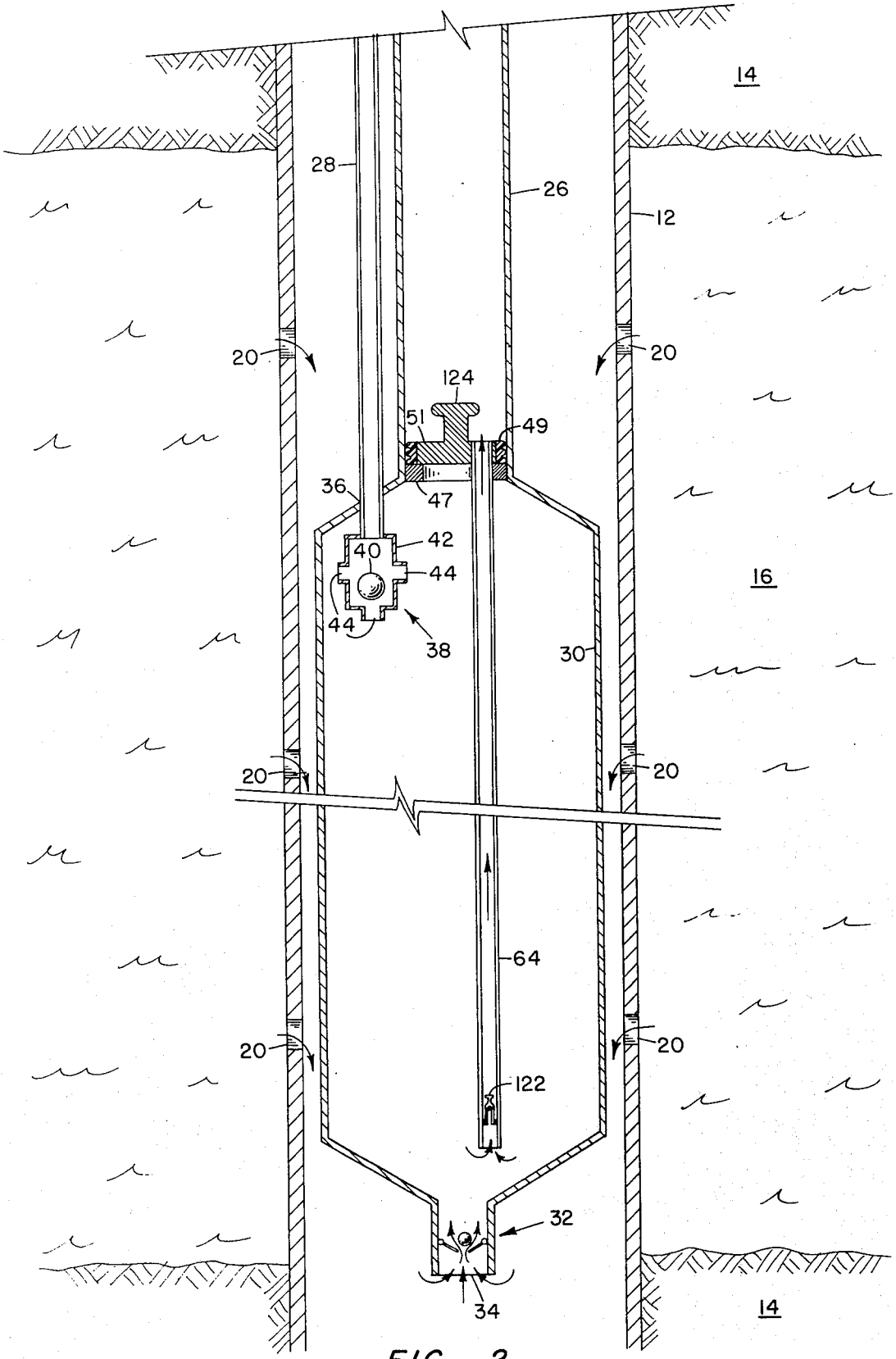
FIG. 2 is an elevated partial view of FIG. 1 showing an alternative embodiment.

Referring to FIG. 1 of the drawings in conjunction with the following specification, a better understanding of the invention can be obtained. A hydrocarbon producing well represented generally by the reference numeral 10 is shown in a sectional view with the casing of the well being represented by reference numeral 12. The casing 12 of the well 10 extends down through the earth 14 to a hydrocarbon producing zone 16 located some distance below the earth's crust. The casing 12 is usually cemented into place by cement 18 near the surface of the well. In the hydrocarbon producing zone 16 the casing 12 has perforations 20 to allow a substance such as oil from the hydrocarbon producing zone 16 to flow into the casing 12. At the top of the casing 12 there is located a casing head clamp 22 that may or may not seal off the well head according to the circumstances of the individual well. In conjunction with the present invention, the casing head clamp 22 is shown with a vented well head through opening 24.

From the well head production tubing 26 and vent-/compressor line 28 is run into the well. It should be noted that the vent/compressor line 28 is a fairly small diameter line with an inside diameter of probably less than 1 inch; however, the production tubing 26 could be several inches in diameter. The bottom of the production tubing 26 has an expanded diameter to form an accumulator 30 which may be located in the hydrocarbon producing zone 16. However, accumulator 30 need only be inserted in the well 10 to such a depth that oil from the hydrocarbon producing zone 16 will accumulate therein. This depth may be above or below the hydrocarbon producing zone 16. At the bottom of the accumulator 30 is a check valve 32 that allows oil to enter through opening 34 into accumulator 30. Check valve 32 prevents the oil from draining from accumulator 30 once it has been collected therein. The check valve 32 may be constructed as a standing valve so that it may be retrieved from the surface and access be obtained to the bottom of the well 10 without removing the accumulator 30.

The vent/compressor line 28 extends down inside of accumulator 30 through opening 36 in an airtight manner. Opening 36 is attached to the vent/compressor line 28 by any conventional means such as welding. Immediately inside of accumulator 30 the vent/compressor line 28 is attached to a ball float chamber 38. The ball float chamber 38 has a ball valve 40 inside of housing 42 which has perforations 44 in the side and bottom thereof. The ball float chamber 38 is designed so that the ball 40 will begin to float as fluid in accumulator 30 collects to such an extent that it begins to enter ball float chamber 38 through the perforations 44. As ball valve 40 reaches the top of housing 42 it will seat against the opening between vent/compressor line 28 and housing 42, thereby terminating the venting of accumulator 30 through the vent/compressor line 28.

Immediately above the accumulator 30 in the production tubing 26 is located a seal disc 46, space 48 and another seal disc 50. The seal discs 46 and 50 are made in one integral unit though not shown as such in FIG. 1 for illustration purposes. Seal disc 50 rests against shoulder 47 of casing 26. The circumference of the seal discs 46 and 50 is expandable to form retrievable seal 49. Retrievable seal 49 may be expanded after positioning to very rigidly seal the seal discs 46 and 50 to casing 26 in a manner common to the petroleum industry. Hook 124 attached to the upper surface of seal disc 46 provides a means by which seal discs 46 and 50 and components connected thereto may be retrieved from the well 10.

Extending through seal discs 46 and 50 is a pressure line 52 which has a gas lift valve 54 connected to the lower end thereof. The gas lift valve 54 is of the traditional type having a ball 56 pushed against seat 58 by a bellows 60 which receives external pressure through opening 62. The gas lift valve 54 is designed with the bellows 60 having a larger pressure area inside of valve 54 than ball 56 so that once a certain pressure external to the gas lift valve is reached the ball 56 will unseat thereby allowing the pressure to flow through pressure line 52 and past seal discs 46 and 50.

A stinger tube 64 extends from space 48 through seal disc 50 to a point near the bottom of accumulator 30. At the bottom of stinger tube 64 is a standing valve 122 to allow oil collected in accumulator 30 to flow into the stinger tube 64. The standing valve 122 operates in much the same manner as a check valve to allow flow in one direction.

Seal discs 46 and 50, along with the associated pressure line 52, gas lift valve 54, stinger tube 64 and standing valve 122, can be made integrally as one element so that they may be retrieved from production tubing 26 in a manner very similar to a retrievable tubing stop commonly used in the petroleum industry. By making the seal discs 46 and 50 in the form of retrievable tubing stop, direct access may be obtained to the accumulator 30 from the well head. Seal discs 46 and 50 are used for illustration purposes.

From space 48 a bypass tubing 66 extends upward and reconnects with production tubing 26. The purpose of the bypass tubing 66 is to extend around free floating piston or swab 68 which is contained in the production tubing immediately above seal disc 46 with a heavy spring 70 located therebetween. The free floating piston 68 may be of a type manufactured by McMurry Oil Tools Inc. of Houston, Texas, having a trade name of McMurry Plunger. Other types of free floating pistons or swabs could be used in place of free floating piston 68 as long as a good seal is maintained between the free floating piston 68 and the internal walls of production tubing 26.

At the surface of the hydrocarbon producing well 10 is located the control portion 72 of the artificial lift apparatus previously described as located in the well 10. The production tubing 26 has the typical extended portion 74 to receive the free floating piston 68 while simultaneously routing the oil through horizontal tubing 76 to the oil tank. In the horizontal tubing 76 is located a check valve 78 that will prevent oil from flowing back into the well through production tubing 26 once it has been received in horizontal tubing 76.

The vent/compressor line 28 is connected through a three-way solenoid operated valve 80 to either compressed air or atmosphere. As schematically shown in the present invention, the three-way solenoid operated valve has a coil 82 and core 84 that moves with respect thereto according to the magnetic flux generated by the coil 82. To the core 84 is connected a lever arm 86 which is pivotally connected to housing 88 by pivot pin 90. On the opposite end of lever arm 86 is connected pressure valve 92 and vent valve 94. Pressure valve 92 operates against seat 96 while vent valve operates against seat 98. As shown in the drawing, a three-way solenoid operated valve 80 is energized, thereby forcing pressure valve 92 against seat 96 to stop the flow of compressed air through compressed air tubing 100. The compressed air may be received from any conventional means such as a compressor and associated storage tank that may be used for the entire oil producing field or for the individual hydrocarbon producing well 10. The other side of the three-way solenoid operated value (which is shown as being in fluid communication with the vent/compressor line 28) is connected to vent line 102. Vent line 102 is connected through pressure regulator 104 and (if necessary) choke 106 to atmosphere.

Pressure regulator 104, which may be the typical "Big Joe Regulator" commonly used in the petroleum industry is installed in the reverse of its normal operation. Therefore, if a pressure at point "A" in vent line 102 exceeds a predetermined amount (25 pounds being typical) the regulator 104 will close, thereby preventing flow therethrough; however, any amount of pressure at point B in vent line 102 would not effect the operation of the pressure regulator 104 unless the pressure is reflected at point A. While the three-way solenoid operated valve 80 is in the position shown in FIG. 1 so that the accumulator 30 is being vented, the pressure regulator 104 will remain open because the pressure at point A never exceeds the operation point of the pressure regulator 104.

Interconnecting tubing 108 connects vent line 102 with horizontal tubing 76 that transports the oil to the oil tank. In the interconnecting tubing 108 is a check valve 110 that allows flow from interconnecting tubing 108 into horizontal tubing 76 but not vice versa. Therefore, if a greater pressure is reflected in interconnecting tubing 108 and than in horizontal tubing 76, check valve 110 will open allowing flow therethrough. An additional check valve 112 in horizontal tubing 76 may be necessary between interconnecting tubing 108 and production tubing 26 as will be subsequently described.

To operate the three-way solenoid operated valve 80, a clock 114 and timer 116 are necessary. The clock 114 and timer 116 may be of a typical type so that energy to the three-way solenoid operated valve 80 is interrupted by terminating the power source for a predetermined period of time. Connected to the compressed air tubing 100 and vent line 102 are pressure switches 118 and 120, respectively. Pressure switch 118 is designed to close when compressed air of a predetermined value is available in compressed air tubing 100. Pressure switch 120 is a normally open type of pressure switch so that upon losing pressure the pressure switch will close, thereby forming a closed series circuit with timer 116 to start the time period. As long as the vent/compressor line 28 is venting from the accumulator 30, a slight pressure will be felt by pressure switch 120 because of the choke 106 in the vent line 102. Pressure switch 120 is a standard off-the-shelf item that can sense as extremely low pressure difference created by the normal venting through choke 106. Once enough oil has collected in the accumulator 30 to reach the ball float chamber 38, the ball valve 40 will raise with the oil level to interrupt the vent through vent/compressor line 28. Since no venting is now taking place, the pressure inside of vent line 102 will drop to zero and pressure switch 120 will close, thereby starting the operation of the timer 116. Timer 116 will then interrupt the power that is being supplied through clock 114 to the three-way solenoid valve 80 causing the pressure against pressure valve 92 to force lever arm 86 downward which in turn connects the compressed air to the vent/compressor line 28, and terminate the connection between the vent/compressor line 28 and atmosphere.

METHOD OF OPERATION

Once the artificial lift apparatus has been inserted in the hydrocarbon producing well 10, oil begins to collect in the accumulator 30 by entering through opening 34 and check valve 32. Once the oil in the accumulator 30 has raised to such a level that ball valve 40 seals off the vent/compressor line 28, no more air can be vented from the accumulator 30. At the surface pressure switch 120 will sense a very small drop in pressure that will occur when the vent compressor line 28 has been shut off. The amount of change in pressure reflected in vent line 102 and, consequently, at pressure switch 120 is very small. As the remaining pressure in vent line 102 vents to atmosphere through choke 106 to approach zero pressure, the pressure switch 120 will close to activate the timer 116. Since pressure switch 120 is connected in series with pressure switch 118, compressed air must be connected to compressed air tubing 100 before the timer 116 is activated. Pressure switch 118 is necessary where using a system of wells operated by a single tank and compressor to insure there is sufficient pressure before triggering the timer 116.

When timer 116 is activated, the power source received through clock 114 and timer 116 to three-way solenoid operated valve 80 is terminated, thereby allowing the core 84 to move between the coil 82. Movement of the core 84 moves the lever arm 86 down and unseats pressure valve 92 and seats vent valve 94. During the unseating of pressure valve 92 and the seating of vent valve 94 a small pressure may be felt at point A and vent lines 102 causing the pressure regulator 104 to momentarily close or chatter.

The compressed air is now fed through compressed air tubing 100, three-way solenoid operated valve 80, vent/compressor line 28 into accumulator 30. Check valve 32 prevents the pressurized air from forcing any of the oil back into the earth formation 14 or the hydrocarbon producing zone 16. As pressure builds up in the top of the accumulator 30, the oil will be forced downward and up through stinger tube 64, space 48, bypass tubing 66 into production tubing 26. As the pressure continues to increase in accumulator 30, more of the oil will move up through stinger tube 64. Once a predetermined pressure level has been reached, the gas lift valve 54 will open, thereby introducing pressurized air immediately above seal disc 46 and below free floating piston 68. The point at which the gas lift valve 54 opens should be just before all of the oil in accumulator 30 has moved up through stinger tube 64. Otherwise, the pressurized air entering accumulator 30 through the vent/compressor line would start to bubble through the stinger tube 64, thereby creating an emulsion in the oil. Once the gas lift valve 54 has been set to the approximate pressure this can be controlled by controlling the flow rate of the compressed air into the accumulator 30. A more rapid flow of compressed air into accumulator 30 would trigger the gas lift valve 54 at an earlier point in time before as much of the oil has had a chance to move up through stinger tube 64 into production tubing 26.

As the pressurized air now moves into the zone between seal disc 46 and free floating piston 68, the free floating piston will start to move towards the surface of the hydrocarbon producing well 10. The free floating piston 68 which has seals around the inside surface of the casing 12 to prevent the oil from escaping back to the lower portion of the production tubing 26 begins moving upward. As the pressure is further increased all of the oil above free floating piston 68 and the free floating piston 68 moves to the surface of the well 10. As the oil reaches the surface it is vented out through horizontal tubing 76 into the oil tank. The extended portion 74 allows the free floating piston 68 to be captured (if necessary) for entry into the well. Extra venting (not shown) may be necessary for the extended portion 74 as is common in conjunction with the use of free floating pistons or swabs.

The oil that is above the free floating piston 68 lifts check valves 112 and 78 while flowing through the horizontal tubing 76 into the oil tank. Once the present time of timer 116 has expired (said preset time should be sufficient to raise the piston 68 to the well head), the three-way solenoid operated valve 80 will reenergize to close pressure valve 92 and open vent valve 94. The pressure contained in accumulator 30 and the vent/compressor line 28 is now felt in vent line 102. Since point A of vent line 102 now has a pressure that exceeds the pressure that the regulator 104 is attempting to control, the pressure regulator 104 will close. Therefore, the only path left for all of the air pressurized in accumulator 30 is through check valve 110 into horizontal tubing 76. This pressure will force check valve 112 to close and check valve 78 to remain open. The air pressure discharged from accumulator 30 will now force the air in horizontal line 76 to move into the storage tank. If sufficient pressure was available in production tubing 26 and accumulator 30, check valve 112 may not in fact be necessary. However, to insure that the pressurized air moves towards the oil tank instead of back into the well 10, check valve 112 has been included. As the pressure in accumulator 30 and the vent/compressor line 28 continues to decrease, it will reach the set point for the pressure regulator 104. Once the set point has been reached at point A, the regulator 104 will again open, thereby allowing the accumulator 30 to vent to atmosphere. Unless the free floating piston 68 is caught in the extended portion 74, it will be allowed to fall back down the production tubing 26 until it hits heavy spring 70. Heavy spring 70 will absorb the impact of free floating piston 68 to prevent damage to the apparatus contained therebelow.

It should be realized that the three-way solenoid operated valve 80 could be replaced with two independent solenoid operated valves, with a normally closed valve being in compressed air tubing 100 and a normally open valve being in vent line 102. Then the timer 116 would simultaneously energize both valves upon receiving the signal from pressure switches 118 and 120.

Also, the three-way solenoid operated valve 80 has been described as being continuously energized when in fact it may be reverse type wherein the lever arm 86 is biased upward and additional force of current flowing through the coil 82 is necessary to overcome the bias against the lever arm 86.

There are various modifications of the artificial lift apparatus described in the present invention such as the seal casing head, or packers above and/or below the production zone. The accumulator 30 may be of varying lengths with a typical length being possibly 100 feet. How the artificial lift apparatus is used will depend upon the characteristics of the individual well. Because of the extreme simplicity of the apparatus located at the bottom of the well, the life expectancy of that portion of the apparatus located in the well is extremely long. Therefore, it now becomes economically feasible to continue to operate the hydrocarbon producing well 10 much longer than previously possible. Another reason that the productive life of the well is now extended is because the pressure being fed into the well is applied to a much smaller diameter area than the casing 12 as was the case in the previous method of gas lift using a swab or free floating piston. Because the area of the casing 12 is much greater than the area of the vent-/compressor line 28 and production tubing 26 it will withstand much less pressure than is possible with the present artificial lift apparatus. Assuming that surface power is lost on the control portion 72 or it is shut off due to production requirements for the field, oil may accumulate in the production tubing 26 to form an oil column of a substantial height. Because of the smaller area of the production tubing 26 and the vent/compressor line 28, and due to special construction of the accumulator 30, a rather substantial pressure can be built up below free floating piston 68 to raise a rather substantial column of oil in the production tubing 26 to the well head. Depending upon the characteristics of the individual well, a number of different methods may be used to bring a well back into production.

The first and most obvious method is to use a portable compressor to increase the pressure in the well to such an extent it will raise the entire column of oil to the well head. During normal production a much smaller and less expensive compressor may be used.

The second method would be to use a swab and line to swab out the well by lowering the swab part of the distance into the accumulated oil and pulling the swab and oil to the well head by the line. This would be repeated until the column of oil is reduced and normal production may be resumed.

A third and more costly method would be to raise the accumulator in the column of oil, and gradually lower the accumulator as the column of oil is decreased until normal production resumes.

If the alternative embodiment (subsequently described) is utilized, the methods immediately above of resuming normal production do not apply.

The particular stage in the productive life of a hydrocarbon producing well wherein the present artificial lift apparatus becomes economically feasible will vary. However, it could be used in the second stage in place of gas lift especially when a ready source of gas is not available. The present apparatus which does not bubble the air through the oil does not create an emulsion which is harmful to the end product.

In the present artificial lift apparatus, by venting the accumulator to the atmosphere, the hydrocarbon producing well may be economically feasible to operate until the bottom hole pressure has reached zero. In wells that have a sump bore below the pay zone, it may even be economically feasible to use the present artificial lift apparatus in wells where the bottom hole pressure has decreased below zero. This type of production will depend upon latent water drive, changes in the earth, underground formations, gravity, contributions from other zones not completely depleted, etc. By using the present artificial lift apparatus, hydrocarbon producing wells can be continually produced on an economical basis almost exponentially. In the petroleum industry, it is not economically feasible to continue to operate the well beyond some minimum product per day depending on the individual well characteristic. Using the present type of artificial lift apparatus the well can be operated long after other devices are no longer practical. Most hydrocarbon producing wells are abandoned when they still have approximately 40 or 50 percent of their theoretical productive capacity remaining. The present artificial lift apparatus is designed primarily for getting that extra 40 or 50 percent from the well plus decreasing the cost for artificial lift at earlier stages in the productive life of the well.

ALTERNATIVE EMBODIMENT

Referring now to FIG. 2 of the drawings, there is shown an alternative embodiment of the present invention. In the alternative embodiment, which is much simpler than the preferred embodiment, the piston 68 and spring 70 have been eliminated. Gas lift valve 54, pressure line 52 and bypass tubing 66 are no longer necessary so they have not been shown in FIG. 2. To change from the preferred embodiment to the alternative embodiment, the piston 68 should be trapped in extended portion 74. Thereafter, a line can be run into the well and hooked on hook 124 to retrieve the apparatus connected to discs 46 and 50. By sealing gas lift valve 54 shut the same apparatus may be lowered back into the well 10. Because discs 46 and 50 now function as a single disc, they are incorporated in disc 51 of FIG. 2.

It should be realized that FIG. 2 shows only the essential components in the well 10 rather than how it would have looked if the preferred embodiment of FIG. 1 had been changed to the alternative embodiment of FIG. 2. Since the control portion above the well 10 is essentially the same, it has not been shown again in FIG. 2.

In the alternative embodiment of FIG. 2, the accumulator 30 is vented to atmosphere through ball float valve 38. Same as previously discussed, when the ball float valve 38 blocks vent/compressor line 28 indicating the accumulator 30 is full of oil, the control portion 72 (see FIG. 1*a*) starts pressuring the accumulator 30 through vent/compressor line 28. Essentially, all the oil in accumulator is forced through the standing valve 122 and stinger tube 64 into the production tubing 26. Now the cycle of the timer 116 is decreased so that the movement of the oil into the production tubing 26 is the function accomplished. Afterwards, the accumulator 30 is again vented to atmosphere to allow further collection of oil in the accumulator 30. The cycle is repeated when the accumulator 30 is full. This cycle is repeated again and again until the column of oil in the production tubing 26 reaches the well head. Standing valve 122 prevents the reverse flow of oil back into the accumulator. Further cycles will now cause oil to flow in horizontal tubing 76 on each cycle.

It may be necessary to increase the time of each cycle while bringing a well into production because of the increased pressure necessary to force the increasingly long oil column up the production tubing. Once the well starts flowing, the time cycle may be fixed. Otherwise, for a fixed pressure, either the pressure will not be enough to bring the well into production, or an emulsion between the air and oil will be created during the initial cycles.

The stinger tube 64 could be a simple extension of the production tubing 26 into the accumulator 30 without the necessity of seal disc 51. The only limitation on the alternative embodiment is the amount of pressure that can be exerted on vent/compressor line 28, accumulator 30, and production tubing 26. Because of the decreased diameter when compared to casing 12, a tremendously increased pressure can be exerted that could not be exerted on casing 12 of previous artificial lift system. A typical diameter of the production tubing 26 could be 2 inches, that diameter combating flow resistance due to friction for smaller diameters.

In utilizing the present invention, a packer is not necessary. However, if circumstances of the well so dictate, such as a water zone above the oil zone or casing that has been blown off, a packer may be used. By using a packer, many wells that have been blown and plugged may be brought back into production using the present invention on an economic basis.

The individual characteristics of the well will dictate which of the embodiments of the present invention should be utilized. Because the alternative embodiment raised the entire column of oil to the well head, a much larger pressure is necessary than required for the preferred embodiment utilizing a piston. Therefore, if the well is too deep (also considering the other characteristics), the piston type of the preferred embodiment may be more practical because of the small compressor necessary for operating the well or system of wells. This determination should be made before initial installation, though the present embodiments may be changed later with a minimum of effort.

What is claimed is:

1. An artificial lift apparatus for a hydrocarbon producing well having a well head and a well casing therein, said apparatus comprising:

production tubing extending from the well head into the casing to a level below which the hydrocarbon will naturally fill through perforations in the casing;

accumulator means attached to the bottom of the production tubing for collecting hydrocarbon in the well;

gas tubing means extending from the well head into the accumulator means for communication therewith from the well head;

piston means located in said production tubing and normally positioned above said accumulator means, said piston means being free to move up and down said production tubing;

path means communicating with said accumulator for moving hydrocarbon above said piston means when said piston means is in its normal position;

first check valve means for only allowing flow of hydrocarbon into said accumulator means;

means fluidly communicating said accumulator with the lower face of said piston means so that the piston moves up and down in response to the pressure within said accumulator;

control means for alternately venting and pressurizing said accumulator means via said gas tubing means, hydrocarbon being allowed to collect in said accumulator means via said check valve means during venting, thereafter, in response to said pressurizing, said hydrocarbon is moved through said path means above said piston means in said production tubing and raised to the well head with said piston means as pressure in said accumulator continues to increase.

2. The artificial lift apparatus as given in claim 1 further includes conduit means for receiving and handling said hydrocarbon at said well head.

3. The artificial lift apparatus as given in claim 2 includes means in said accumulator to prevent pressure from said accumulator from building up under said piston means until a predetermined pressure level has been reached.

4. The artificial lift apparatus as given in claim 3 wherein said path means includes stinger tube means extending to approximately the bottom of said accumulator means, said path means being a bypass around said piston means for raising hydrocarbon above said piston means via said stinger tube means in response to said pressurizing of said accumulator means.

5. The artificial lift apparatus as given in claim 4 wherein said means for preventing pressure from building up includes a gas lift valve in said accumulator, said gas life valve opening in response to said predetermined pressure.

6. The artificial lift apparatus as given in claim 5 includes second check valve means to prevent hydrocarbon in said conduit means from reentering said production tubing and spring means for absorbing the impact of said piston means upon falling to said normal position.

7. The artificial lift apparatus as given in claim 1 wherein said control means includes a normally open valve connecting said gas tubing means to atmosphere, and a normally closed valve connecting said gas tubing means to a source of pressurized gas, said normally open valve and said normally closed valve switching in response to a control signal.

8. The artificial lift apparatus as given in claim 7 wherein said control signal is generated by a first pressure switch in a vent line from said normally open valve to atmosphere, said vent line having a choke therein to measure small pressures from said accumulator means, the lower end of said gas tubing means having a float valve for closing upon the filling of said accumulator means with hydrocarbon, said control signal being generated upon closing said float valve and subsequent loss of pressure on said first pressure switch.

9. The artificial lift apparatus as given in claim 8 wherein said normally open valve and said normally closed valve are parts of a three-way valve means operated by said control signal, said control signal being maintained for a given time period by a timer, said time period being sufficient to raise hydrocarbon to the well head.

10. The artificial lift apparatus as given in claim 7 further includes a pressure regulator between said normally open valve and atmosphere for maintaining pressure in said gas tubing means, alternative conduit and third check valve means connecting said normally open valve to a conduit means for receiving and handling said hydrocarbon at said well head, after termination of said control signal said pressurization of said accumulator means is discharged through said third check valve means to move hydrocarbon further along the conduit means, fourth check valve means in said conduct preventing said hydrocarbon from flowing back into said well.

* * * * *